US007281954B1

(12) United States Patent
Hashiguchi

(10) Patent No.: US 7,281,954 B1
(45) Date of Patent: Oct. 16, 2007

(54) SOCKET CONNECTOR IMPROVED IN ADAPTABILITY TO A TERMINAL POSITION OF A CONNECTION OBJECT

(75) Inventor: Osamu Hashiguchi, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 11/655,662

(22) Filed: Jan. 19, 2007

(30) Foreign Application Priority Data

Jan. 20, 2006 (JP) ..... 2006-012618
Feb. 10, 2006 (JP) ..... 2006-033886

(51) Int. Cl.
*H01R 24/00* (2006.01)

(52) U.S. Cl. ..... 439/660; 439/71

(58) Field of Classification Search ..... 439/660, 439/609, 108, 330, 357, 71
See application file for complete search history.

(56) References Cited

U.S. PATENT DOCUMENTS 4,936,784 A * 6/1990 Saito ..... 439/72
7,086,902 B1 * 8/2006 Yang ..... 439/607
7,112,083 B2 * 9/2006 Nishio et al. ..... 439/331
7,121,864 B1 * 10/2006 Yang ..... 439/331
7,150,653 B1 * 12/2006 Mason ..... 439/609
7,156,679 B1 * 1/2007 Wang et al. ..... 439/330
7,160,116 B2 * 1/2007 Li ..... 439/73

FOREIGN PATENT DOCUMENTS

JP 2003-092168 A 3/2003
JP 2004-241225 A 8/2004

* cited by examiner

*Primary Examiner*—Michael C. Zarroli
*Assistant Examiner*—Phuongchi Nguyen
(74) *Attorney, Agent, or Firm*—Collard & Roe, P.C.

(57) ABSTRACT

In a socket connector for connecting a first connection object to a second connection object, a housing has a receiving portion for receiving the first connection object in an inserting direction and holds a conductive contact and a conductive engaging member. The contact has a spring portion for applying, to the first connection object received in the receiving portion, an urging force in a removing direction opposite to the inserting direction. The contact further has a contacting portion to be contacted with a first connecting portion of the first connection object and a terminal portion to be electrically connected to the second connection object. The engaging member has a locking portion to be brought into contact with an engaging portion of the first connection object by the use of the urging force. The locking portion is contacted with the second connecting portion.

14 Claims, 14 Drawing Sheets

SOCKET CONNECTOR IMPROVED IN ADAPTABILITY TO A TERMINAL POSITION OF A CONNECTION OBJECT

This application claims priority to prior Japanese patent applications JP 2006-12618 and JP 2006-33886, the disclosures of which are incorporated herein by reference.

BACKGROUND OF THE INVENTION

This invention relates to a socket connector and, in particular, to a socket connector for use in connecting a first connection object, such as a semiconductor device module and a semiconductor package, and a second connection object, such as a printed circuit board.

As a socket connector of the type, there is known a module connector having a structure such that, even if a dimensional difference due to tolerance is caused in electronic parts, a first connection object is reliably engaged with the socket connector so as to maintain stable contact or electrical connection between a contact and an electrode (see Japanese Unexamined Patent Application Publication (JP-A) No. 2003-92168).

There is also known a module socket having a structure assuring a sufficient spring span of a ground contact fixed to an insulating case of a limited size (see Japanese Unexamined Patent Application Publication (JP-A) No. 2004-241225).

Each of the above-mentioned socket connectors is adapted to receive a first connection object inserted in one direction and to connect a second connection object in a direction opposite to the one direction. When the first connection object is mounted to the socket connector, the contact of the socket connector is contacted with a terminal disposed on a mounting surface of the first connection object or in the vicinity thereof. However, it is impossible to connect a connection object having a terminal at a position except on the mounting surface or in the vicinity thereof. Thus, these socket connectors are inconvenient in structure because of unadaptability to a terminal position of the connection object.

SUMMARY OF THE INVENTION

It is therefore an object of this invention to provide a socket connector having a structure such that, even if a connection object has a connecting terminal at a position except on a mounting surface or in the vicinity thereof, stable connection is achieved.

It is another object of this invention to provide a socket connector excellent in handlability of a connection object and operability of a fitting operation.

It is still another object of this invention to provide a socket connector capable of absorbing dimensional variation of an engaging member or a connection object to maintain a high reliability of connection.

Other objects of the present invention will become clear as the description proceeds.

According to an aspect of the present invention, there is provided a socket connector for connecting a first connection object to a second connection object, the first connection object having a first connecting portion and an engaging portion formed on opposite sides in an inserting direction, the engaging portion having a second connecting portion having a plane perpendicular to the inserting direction, the socket connector comprising a housing having a receiving portion for receiving the first connection object in the inserting direction, a conductive contact held by the housing, and a conductive engaging member held by the housing, the contact comprising a spring portion for applying, to the first connection object received in the receiving portion, an urging force in a removing direction opposite to the inserting direction, a contacting portion to be contacted with the first connecting portion, and a terminal portion to be electrically connected to the second connection object, the engaging member having a locking portion to be brought into contact with the engaging portion by the use of the urging force, the locking portion being contacted with the second connecting portion.

DESCRIPTION OF THE PREFERRED EMBODIMENTS

Referring to FIGS. 1 to 5C, description will be made of a socket connector according to a first embodiment of this invention.

Figure 1:
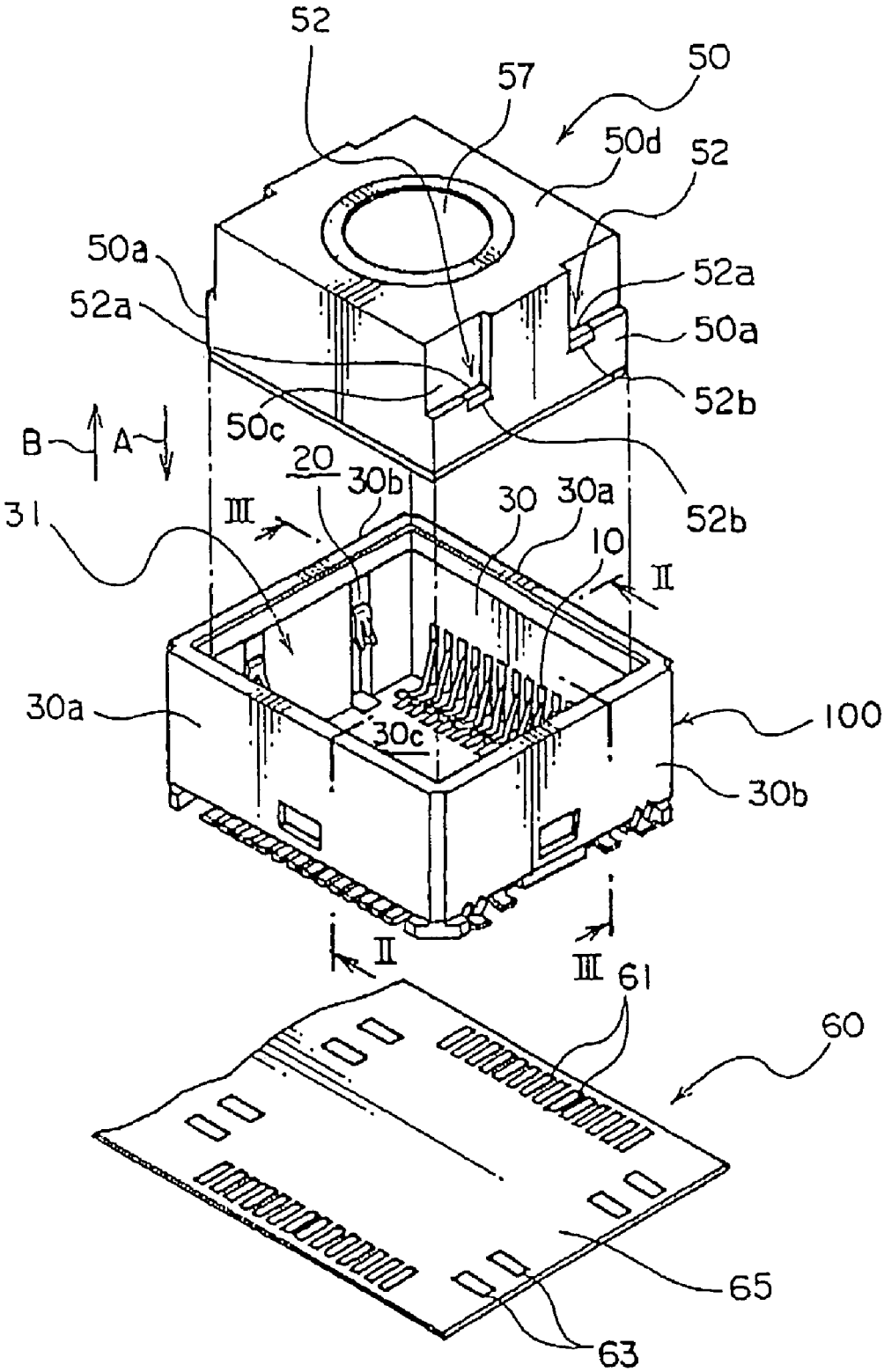
FIG. 1 is a perspective view of a socket connector according to a first embodiment of this invention together with first and second connection objects before connection.

In FIG. 1, the socket connector depicted at 100 serves to electrically connect a first connection object 50 and a second connection object 60 to each other. The first connection object 50 is adapted to be fitted to the socket connector 100 in a fitting direction A and to be removed from the socket connector 100 in a removing direction B opposite to the fitting direction A. The second connection object 60 is brought into contact with a bottom surface of the socket connector 100.

The first connection object 50 is, for example, a camera module or an IC package. The second connection object 60 is, for example, a FPC (flexible printed circuit) or a PCB (printed circuit board).

Figure 2:
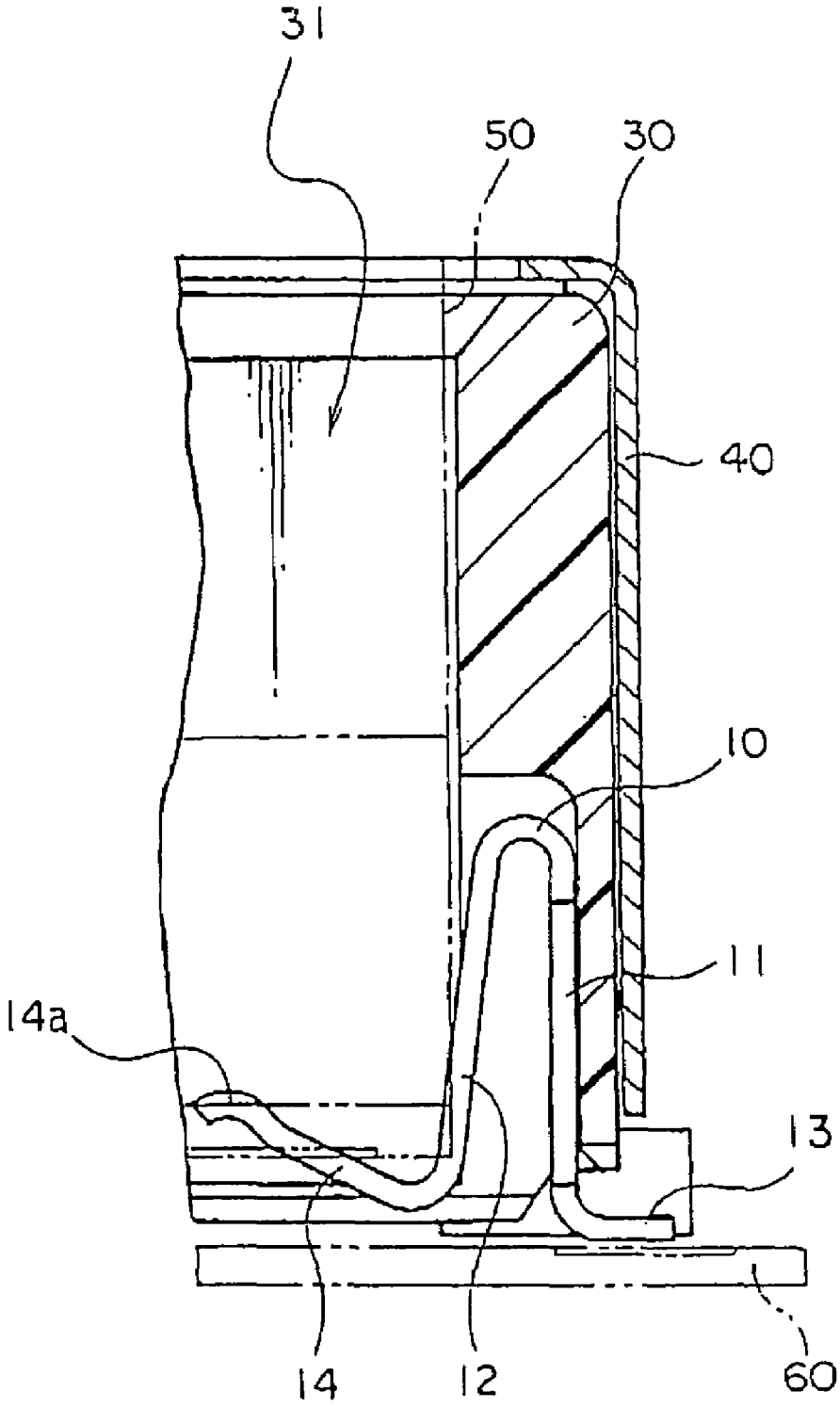
FIG. 2 is an enlarged sectional view of a characteristic part only, taken along a line II-II in FIG. 1.

The socket connector 100 comprises a plurality of conductive contacts 10, a plurality of conductive engaging members 20, which are also called latches, and an insulating housing 30 holding the contacts 10 and the engaging members 20. As shown in FIG. 2, each contact 10 has a holding portion 11, a first spring portion 12 continuous from one end of the holding portion 11 and extending to face the holding portion 11, a terminal portion 13 continuous from the other end of the holding portion 11 and adapted to be connected to the second connection object 60, and a second spring portion 14 obliquely extending from an end of the first spring portion 12. The second spring portion 14 has a free end provided with a first contacting portion 14*a* to be connected to the first connection object 50.

Figure 3:
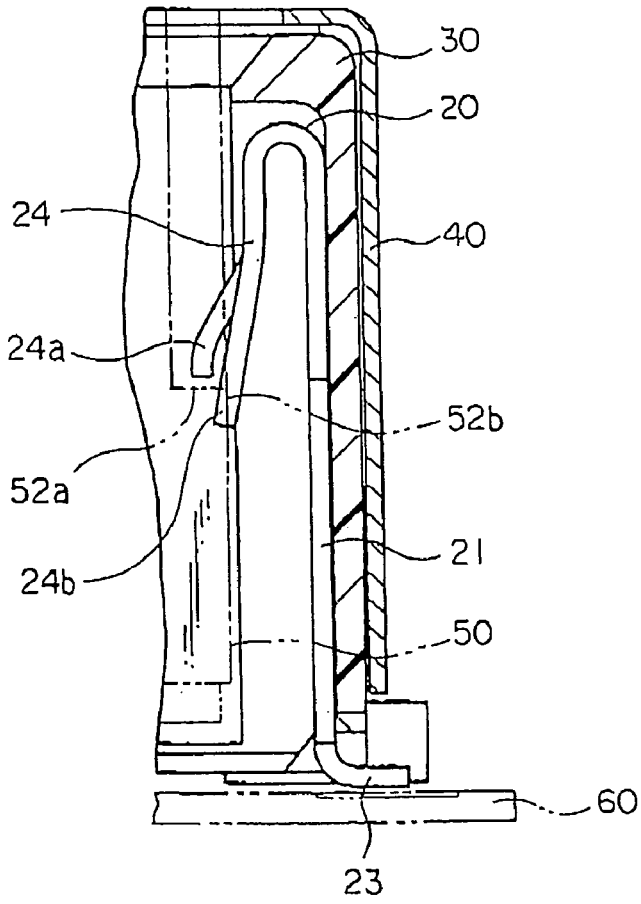
FIG. 3 is an enlarged sectional view of a characteristic part only, taken along a line III-III in FIG. 1.
Figure 4:
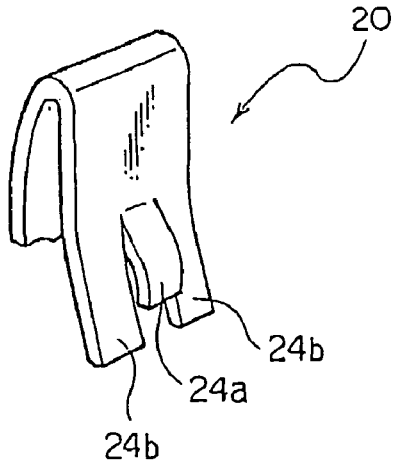
FIG. 4 is a perspective view showing a characteristic part of an engaging member of the socket connector illustrated in FIG. 1.

As shown in FIG. 3, each of the engaging members 20 has an engaging holding portion 21, a first engaging spring portion 24 continuous from one end of the engaging holding portion 21 and extending to face the engaging holding portion 21, and a terminal portion 23 continuous from the other end of the engaging holding portion 21 and adapted to be connected to the second connection object 60. The first engaging spring portion 24 is provided with a locking portion 24*a* for engaging the first connection object 50. The locking portion 24*a* has one end connected to the first engaging spring portion 24 and is a portion formed by cutting and raising a part of a plate surface of the first engaging spring portion 24. The first engaging spring portion 24 has free ends which serve as connecting portions 24*b* to be connected to the first connection object 50.

Turning back to FIG. 1, the housing 30 has a receiving portion 31 defined by a pair of first side wall portions 30*a* faced to each other, a pair of second side wall portions 30*b* connected to the first side wall portions 30*a* and faced to each other, and a bottom portion 30*c* sealing bottom sides of the first and the second side wall portions 30*a* and 30*b*. The receiving portion 31 receives the first connection object 50. The housing 30 has an opening at its upper end.

The holding portions 11 of the contacts 10 are held by the first side wall portions 30*a*. The engaging holding portions 21 of the engaging members 20 are held by the second side wall portions 30*b*.

Figure 5A:
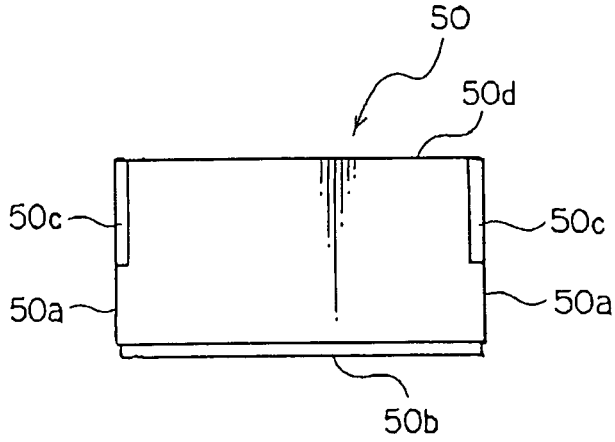
FIG. 5A is a front view of the first connection object to be connected to the socket connector illustrated in FIG. 1.
Figure 5B:
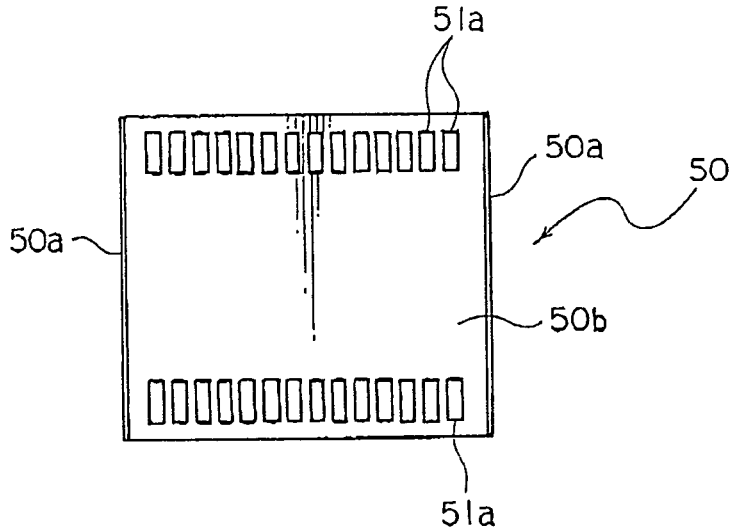
FIG. 5B is a bottom view of the first connection object illustrated in FIG. 5A.
Figure 5C:
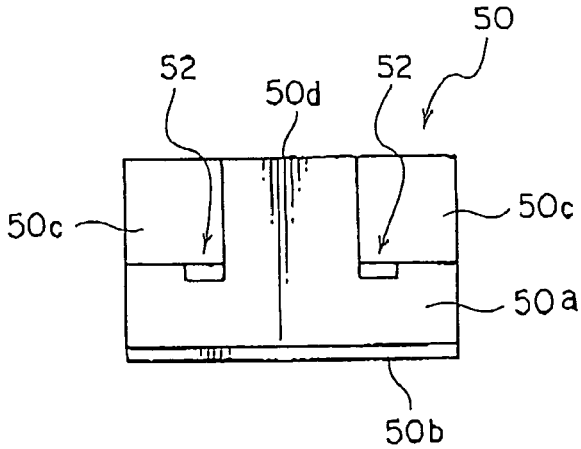
FIG. 5C is a side view of the first connection object illustrated in FIG. 5A.

Referring to FIGS. 5A to 5C in addition, the first connection object 50 has a generally cubic shape. The first connection object 50 has a pair of first connection side wall portions 50*a* faced to each other and a first connection bottom wall portion 50*b*. On the first connection bottom wall portion 50*b*, a number of first connecting portions (electrodes) 51*a* are disposed. Each of the first connection side wall portions 50*a* is provided with a pair of engaging portions 52 adapted to be engaged with the locking portions 24*a* of the first engaging spring portions 24 of the engaging members 20 in the fitting direction A. Specifically, each of the first connection side wall portions 50*a* is provided with a pair of recessed portions 50*c* extending from an upper surface 50*d* towards the first bottom wall portion 50*b*. Each recessed portion 50*c* is depressed from the first connection side wall portion 50*a* so that a step portion is formed at a boundary between the first connection side wall portion 50*a* and the recessed portion 50*c*. The step portion forms the engaging portions 52.

Each of the engaging portions 52 has a second connecting portion (electrode) 52*a* faced to the removing direction B and a third connecting portion (electrode) 52*b* continuous from the second connecting portion (electrode) 52*a* and faced to a direction perpendicular to the removing direction B. Thus, the second connecting portion 52*a* is formed on a plane intersecting an inserting direction, namely, the fitting direction of the first connection object 50 while the third connecting portion 52*b* is formed on a plane parallel to the fitting direction A of the first connection object 50.

In case where the first connection object 50 is a camera module, a lens 57 is mounted at the center of an upper surface 50*d*. The second and the third connecting portions 52*a* and 52*b* serve as electrodes used controlling an operation of a camera.

As shown in FIG. 1, the second connection object 60 has a flexible board 65, a plurality of contact terminal portions 61 disposed on a pair of lateral sides of a surface of the flexible board 65, wiring patterns (not shown in FIG. 1) connected to the contact terminal portions 61, and a plurality of terminal portions 63 disposed on the surface of the flexible board 65 along another side perpendicular to the lateral sides where the contact terminal portions 61 are disposed. The contact terminal portions 61 and the terminal portions 63 can be formed as a part of the wiring patterns into a shape protruding from the board, for example, by etching a copper foil adhered to the surface of the flexible board 65 simultaneously with other wiring patterns and dissolving and removing polyimide resin as a substrate material.

Referring to FIGS. 1 to 3, description will be made of a connecting operation of the above-mentioned socket connector 100.

When the first connection object 50 is inserted into the receiving portion 31 in the fitting direction A, the locking portions 24*a* of the engaging members 20 are pushed by the first connection object 50 so that the first engaging spring portions 24 of the engaging members 20 are elastically bent. Further, the first contacting portions 14*a* of the contacts 10 are pushed by the first connection object 50 so that the second spring portions 14 of the contacts 10 are elastically bent. When the engaging portions 52 pass over the locking portions 24*a*, the first engaging spring portions 24 are restored so that the locking portions 24*a* are faced to the second connecting portions 52*a* and the connecting portions 24*b* are brought into press contact with the second connecting portions 52*b*. By a restoring force of the second spring portions 14 of the contacts 10, the first connection object 50 is lifted up. As a result, the locking portions 24*a* of the engaging members 20 are engaged with the engaging portions 52 of the first connection object 50. At this time, the second connecting portions 52*a* of the first connection object 50 are contacted with the connecting portions 24*b* of the engaging portions. Thus, the first connection object 50 is engaged with the socket connector 100 by the engaging members 20 and electrically connected to the contacts 10 and the engaging members 20.

Further, the socket connector 100 is mounted on the second connection object 60 so that the terminal portions 13 of the contacts 10 and the terminal portions 23 of the engaging members 20 are brought into contact with the contact terminal portions 61 and the terminal portions 63 of the second connection object 60, respectively. Thus, the second connection object 60 is electrically connected to the contacts 10 and the engaging members 20.

The engaging portions 52 of the first connection object 50 may be located on the upper surface 50*b* of the first connection object 50. In this case, the second connecting portions 52*a* are formed on the upper surface 50*d* and brought into contact with the locking portions 24*a* of the engaging members 20.

Referring to FIGS. 6 to 11, description will be made of a socket connector according to a second embodiment of this invention. Similar parts are designated by like reference numerals and description thereof will be omitted.

Figure 8:
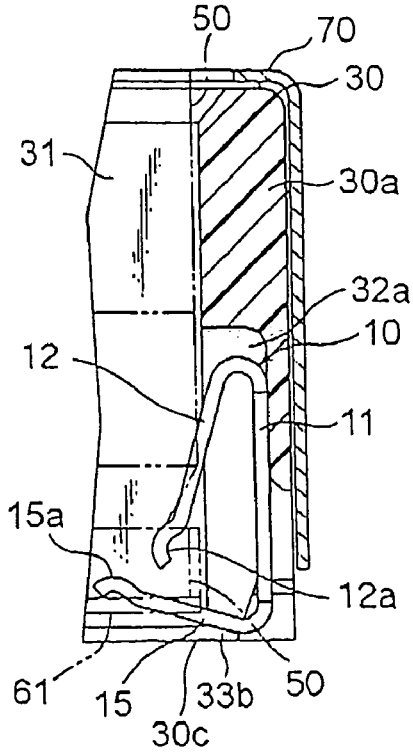
FIG. 8 is a sectional view of a characteristic part only, taken along a line VIII-VIII in FIG. 7A.

In the socket connector 200, each contact 10 has, as shown in FIG. 8, a holding portion 11, a first spring portion 12 continuous from one end of the holding portion 11 and extending to face the holding portion 11, and a second spring portion 15 continuous from the other end of the holding portion 11 and obliquely extending therefrom via a position faced to an end of the first spring portion 12 over the end of the first spring portion 12. The first spring portion 12 has a free end provided with a first contacting portion 12*a* to be connected to the second connection object 60. The second spring portion 15 has a free end provided with a second contacting portion 15*a* to be connected to the second connection object 60. The contact 10 in this embodiment does not have a part corresponding to the terminal portion 13 of the contact illustrated in FIG. 2.

Figure 9:
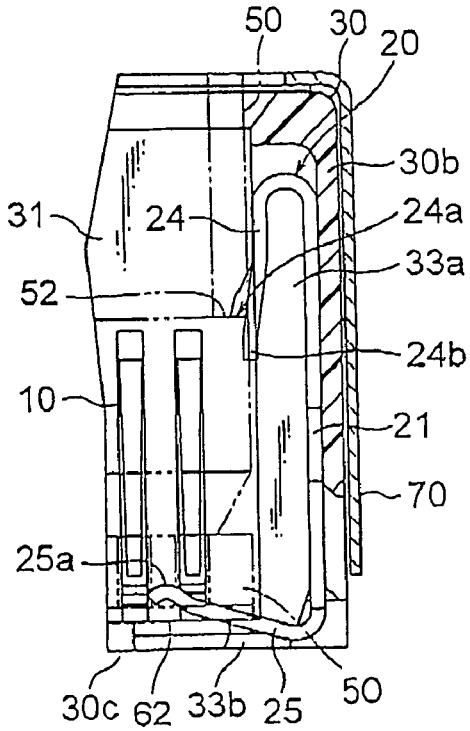
FIG. 9 is a sectional view of a characteristic part only, taken along a line IX-IX in FIG. 7B.

As shown in FIG. 9, each of the engaging members 20 has an engaging holding portion 21, a first engaging spring portion 24 continuous from one end of the engaging holding portion 21 and extending to face the engaging holding portion 21, and a second engaging spring portion 25 continuous from the other end of the engaging holding portion 21 and obliquely extending therefrom via a position faced to an end of the first engaging spring portion 24 over the end of the first engaging spring portion 24. The second engaging spring portion 25 has a free end provided with a contacting portion 25*a* to be connected to the second connection object 60. The engaging member 20 does not have a part corresponding to the terminal portion 23 of the engaging member illustrated in FIG. 3.

The housing 30 is a casing having a bottom portion 30*c* and an opening at its upper end. The housing 30 has a receiving portion 31 which receives the first and the second connection objects 50 and 60. One of second side wall portions 30*b* is provided with a cut portion 30*e* for passage of a conductive portion 60*a* of the second connection object 60.

Each of first side wall portions 30*a* is provided with a plurality of long grooves 32*a* formed on its inner surface and spaced from one another. The holding portions 11 of the contacts 10 are disposed in the long grooves 32*a*, respectively. Thus, the contacts 10 are held so as to be movable with respect to the housing 30 by a predetermined distance in a fitting direction A and a removing direction B. The bottom portion 30*c* continuous from the first side wall portions 30*a* are provided with a plurality of long holes 32*b* continuous from the long grooves 32*a*, respectively. In the long grooves 32*a*, the holding portions 11 of the contacts 10 and parts of the first spring portions 12 except the free ends are disposed in one-to-one correspondence. In the long holes 32*b*, connecting portions of the holding portions 11 and the second spring portions 15 are disposed. The connecting portions of the holding portions 11 and the second spring portions 15 are connected to a circuit of a printed circuit board (not shown) to which the socket connector 200 is mounted.

Each of the second side wall portions 30*b* is provided with a plurality of long grooves 33*a* formed on its inner surface and spaced from one another. The bottom portion 30*c* continuous from the second side wall portion 30*b* is provided with a plurality of long holes 33*b* continuous from the long grooves 33*a*, respectively. In the long grooves 33*a*, the engaging holding portions 21 of the engaging members 20 and parts of the first engaging spring portions 24 except free ends thereof and except free ends of locking portions 24*a* are disposed in one-to-one correspondence. In the long holes 33*b*, connecting portions of the engaging holding portions 21 and the second engaging spring portions 25 are disposed. The connecting portions of the engaging holding portions 21 and the second engaging spring portions 25 are connected to a circuit of the printed circuit board (not shown) to which the socket connector 200 is mounted.

Figure 10A:
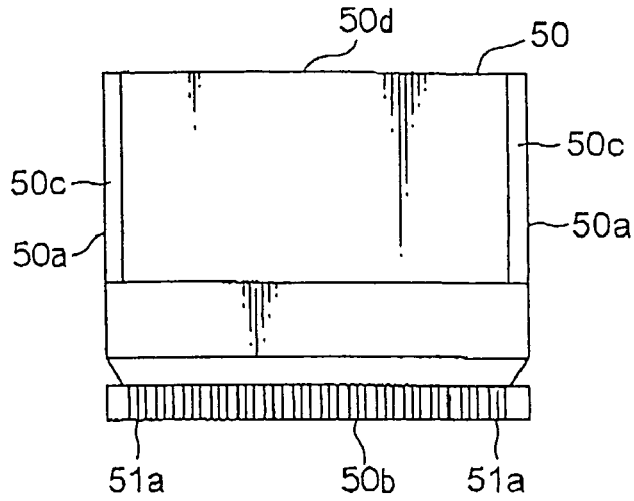
FIG. 10A is a front view of the connection object to be connected to the socket connector illustrated in FIG. 6.
Figure 10B:
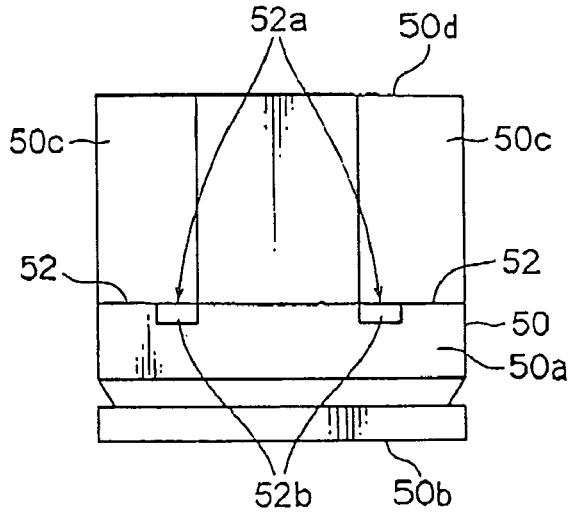
FIG. 10B is a side view of the first connection object illustrated in FIG. 10A.
Figure 10C:
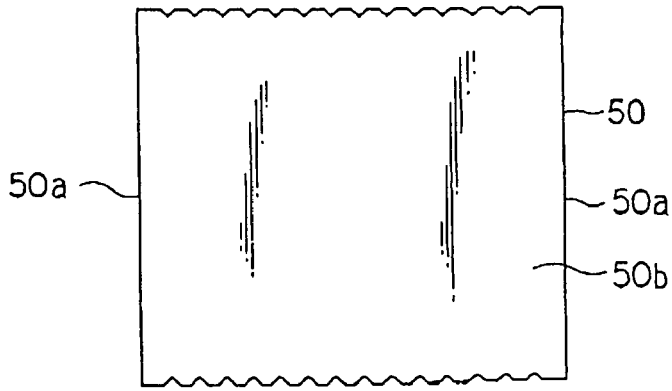
FIG. 10C is a bottom view of the first connection object illustrated in FIG. 10A.

Referring to FIGS. 10A to 10C in addition, the first connection object 50 has a generally cubic shape. The first connection object has a pair of first connection side wall portions 50*a* faced to each other and a first connection bottom wall portion 50*b*. On the first connection bottom wall portion 50*b*, a number of first connecting portions (electrodes) 51*a* are disposed. Each of the first connection side wall portions 50*a* is provided with a pair of engaging portions 52 adapted to be engaged with the locking portions 24*a* of the first engaging spring portions 24 of the engaging members 20 in the fitting direction A. Specifically, each of the first connection side wall portions 50*a* is provided with a pair of recessed portions 50*c* extending from an upper surface 50*d* towards the first bottom wall portion 50*b*. Each recessed portion 50*c* is depressed from the first connection side wall portion 50*a* so that a step portion is formed at a boundary between the first connection side wall portion 50*a* and the recessed portion 50*c*. The step portion forms the engaging portions 52.

Each of the engaging portions 52 has a second connecting portion (electrode) 52*a* faced to the removing direction B and a third connecting portion (electrode) 52*b* continuous from the second connecting portion (electrode) 52*a* and faced to a direction perpendicular to the removing direction B Thus, the second connecting portion 52*a* is formed on a plane intersecting the fitting direction A of the first connection object 50 while the third connecting portion 52*b* is formed on a plane parallel to the fitting direction A of the first connection object 50.

Figure 11:
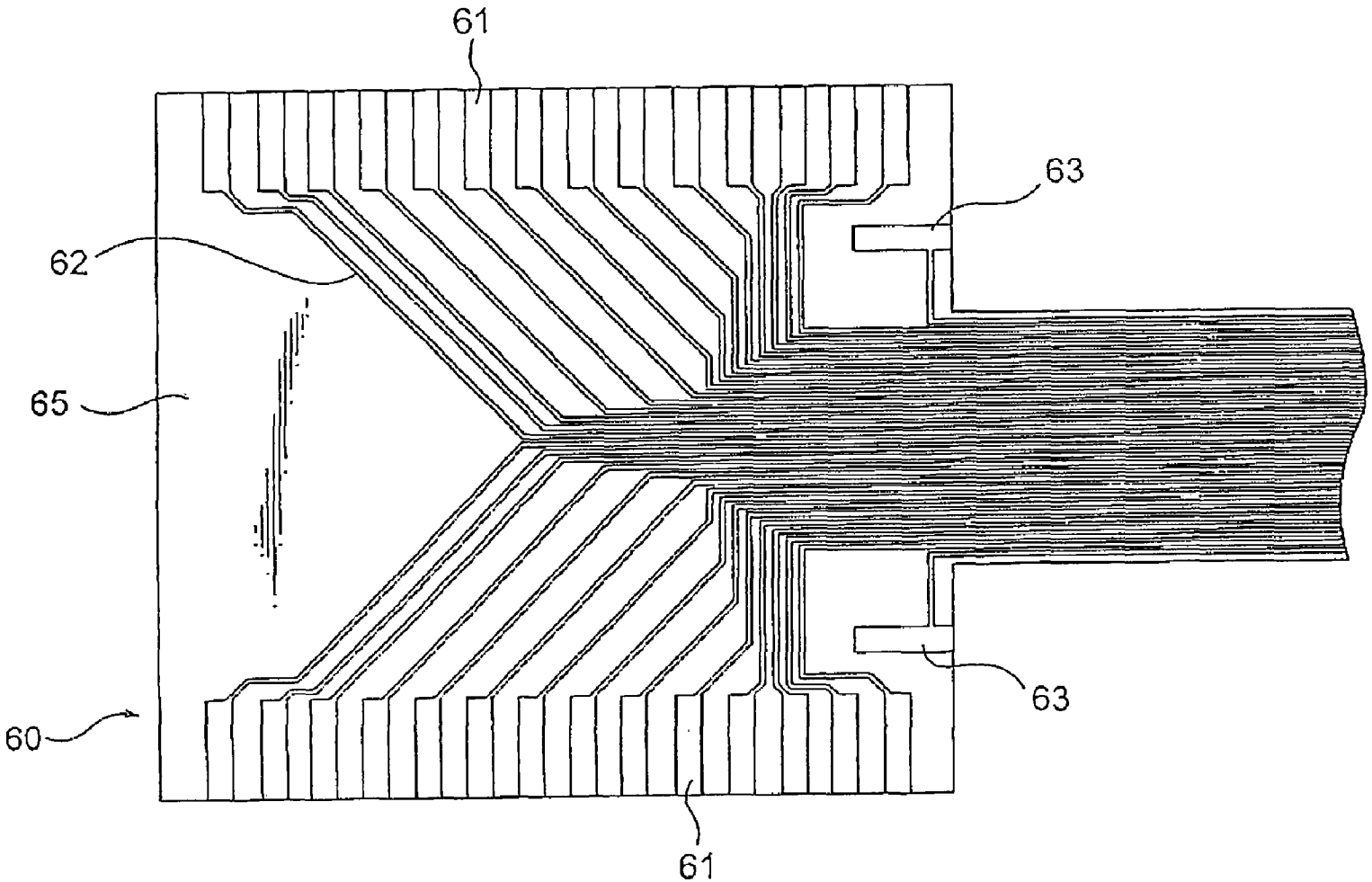
FIG. 11 is a bottom view of the second connection object to be connected to the socket connector illustrated in FIG. 6.
Figure 12:
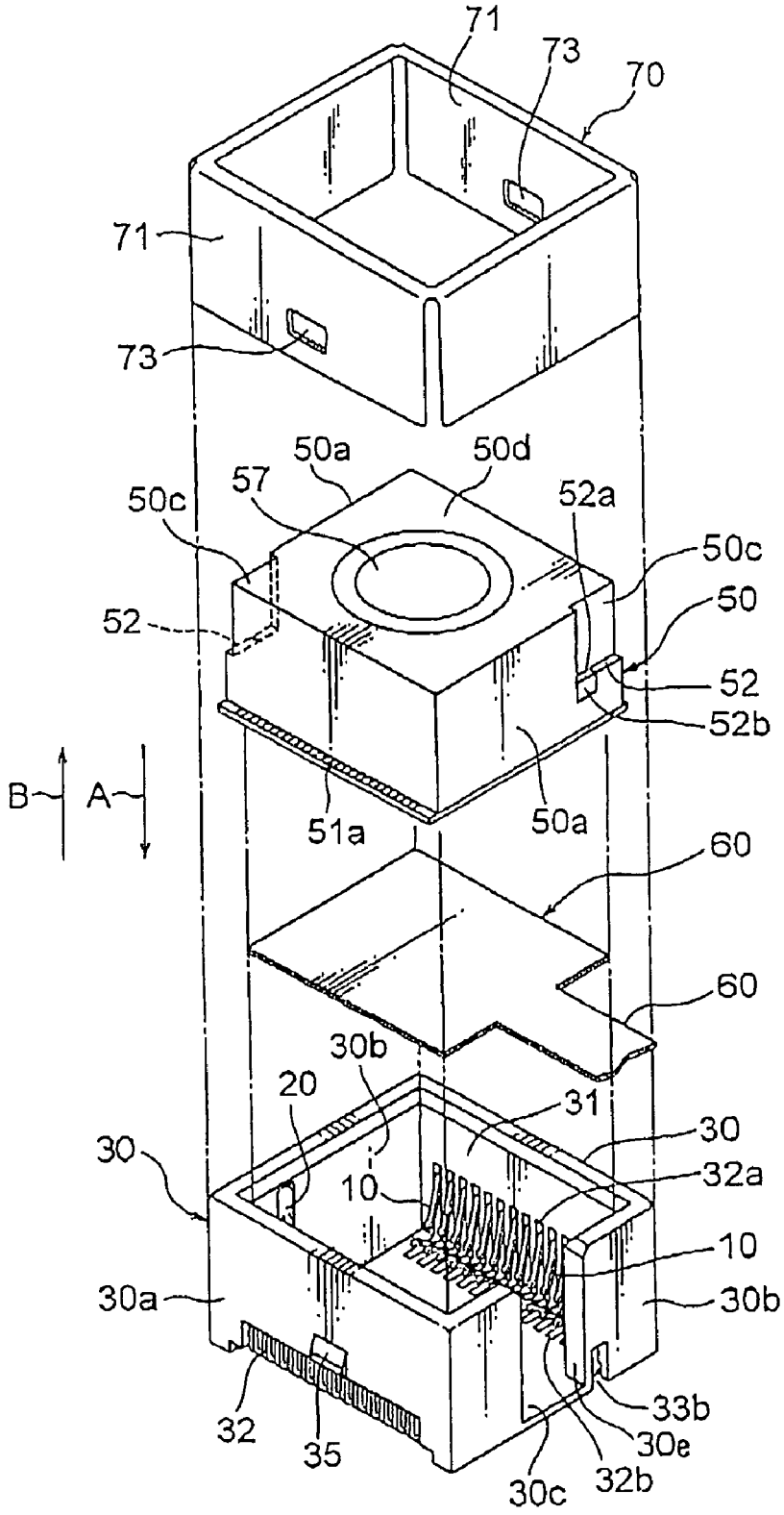
FIG. 12 is an exploded perspective view of a socket connector according to a third embodiment of this invention together with first and second connection objects.
Figure 13A:
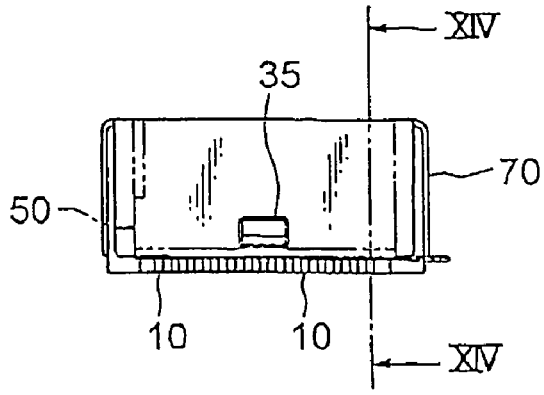
FIG. 13A is a front view of the socket connector illustrated in FIG. 12.
Figure 13B:
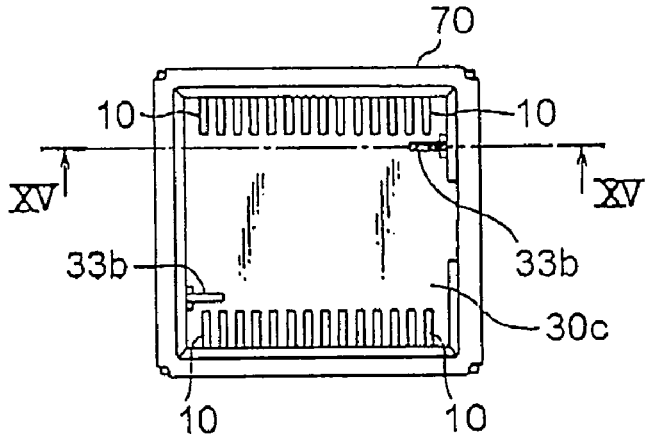
FIG. 13B is a plan view of the socket connector illustrated in FIG. 12.
Figure 13C:
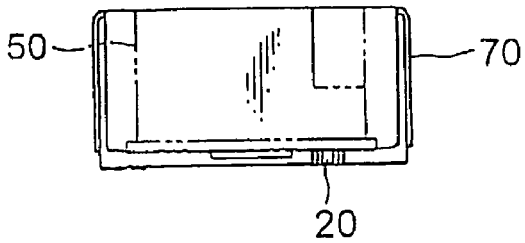
FIG. 13C is a side view of the socket connector illustrated in FIG. 12.
Figure 14:
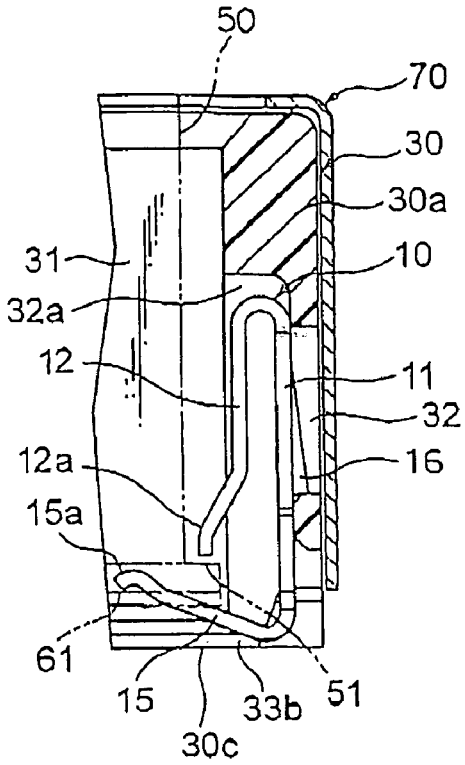
FIG. 14 is a sectional view of a characteristic part only, taken along a line XIII-XIII in FIG. 13A.
Figure 15:
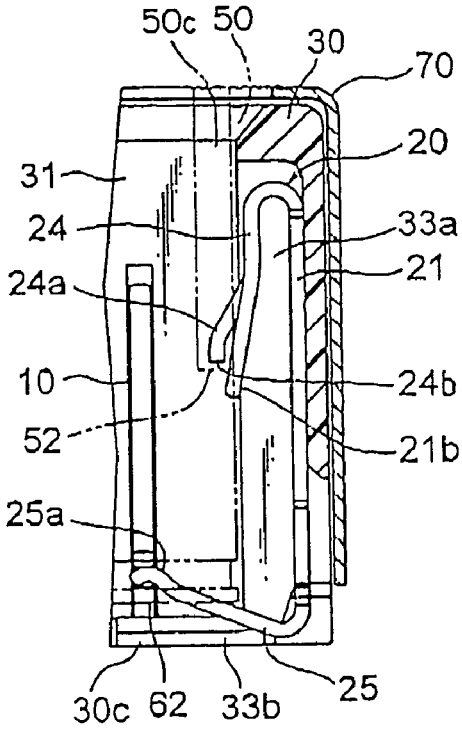
FIG. 15 is a sectional view of a characteristic part only, taken along a line XIV-XIV in FIG. 13B.
Figure 16A:
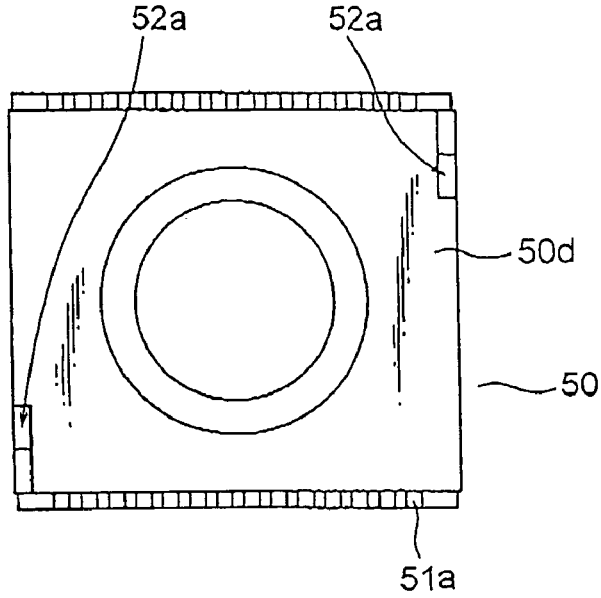
FIG. 16A is a plan view of the first connection object to be connected to the socket connector illustrated in FIG. 11.
Figure 16B:
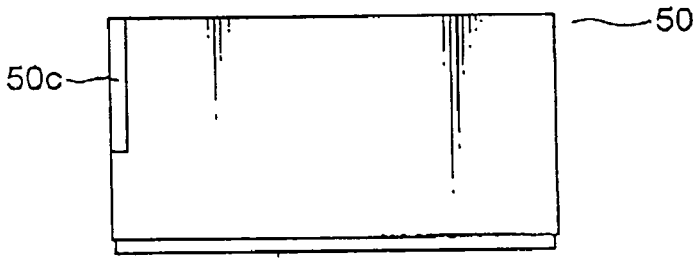
FIG. 16B is a front view of the first connection object illustrated in FIG. 16A.
Figure 16C:
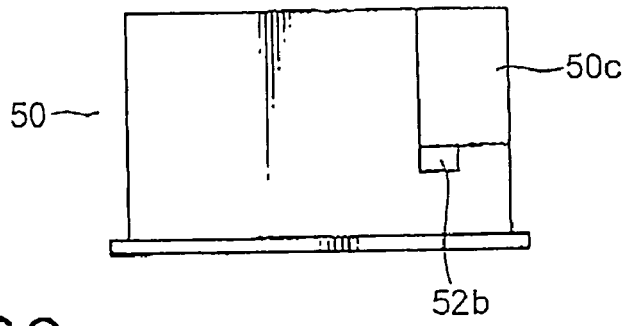
FIG. 16C is a side view of the first connection object illustrated in FIG. 16A.
Figure 17:
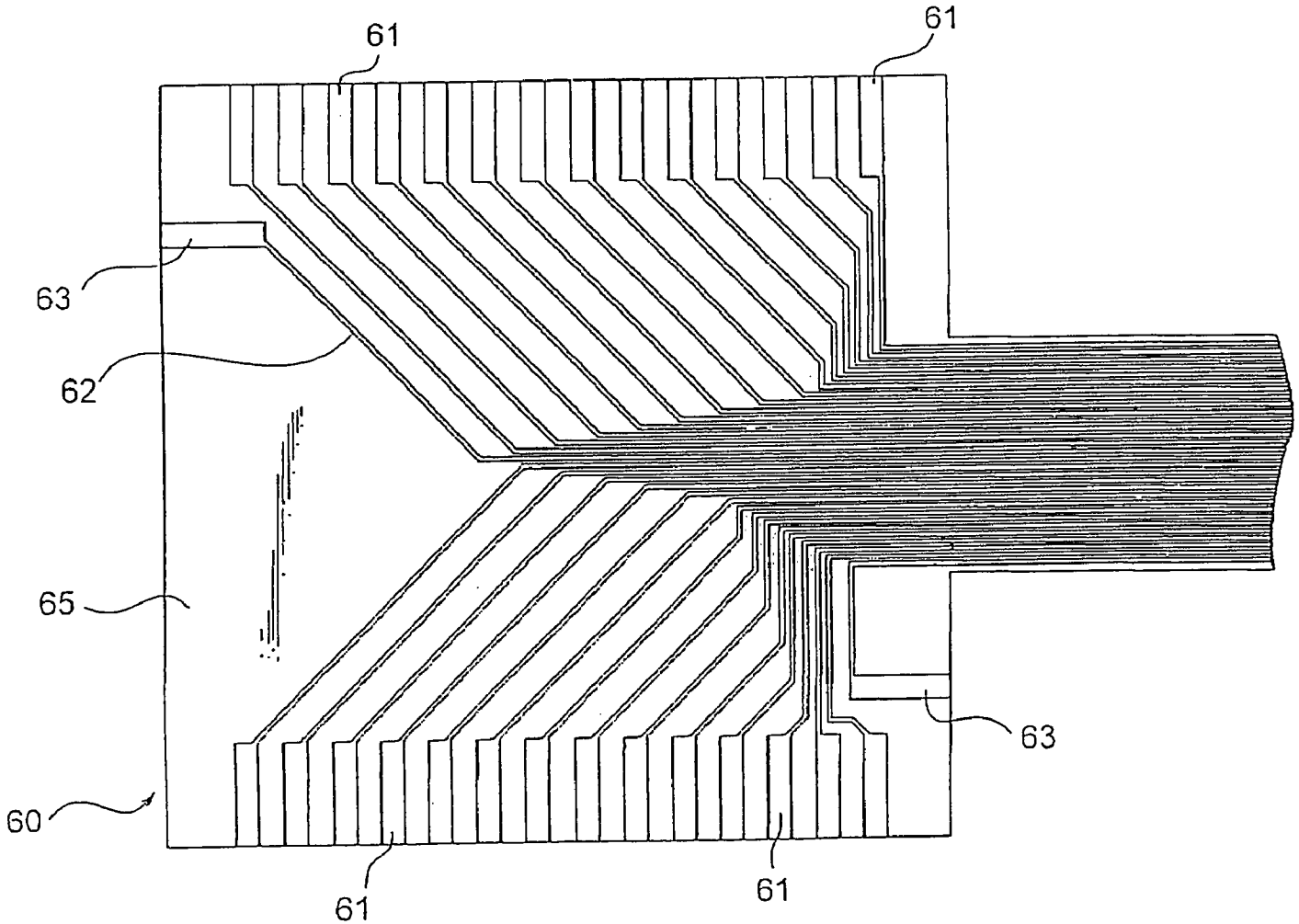
FIG. 17 is a bottom view of the second connection object to be connected to the socket connector illustrated in FIG. 12.

As shown in FIG. 11, the second connection object 60 has a flexible board 65, a plurality of contact terminal portions 61 disposed on a pair of lateral sides of a surface of the flexible board 65, wiring patterns 62 connected to the contact terminal portions 61, and a pair of terminal portions 63 disposed on the surface of the flexible board 65 on one side perpendicular to the lateral sides where the contact terminal portions 61 are disposed.

The contact terminal portions 61 and the terminal portions 63 can be formed as a part of the wiring patterns 62 into a shape protruding from the board, for example, by etching a copper foil adhered to the surface of the flexible board 65 simultaneously with other wiring patterns 62 and dissolving and removing polyimide resin as a substrate material.

Figure 6:
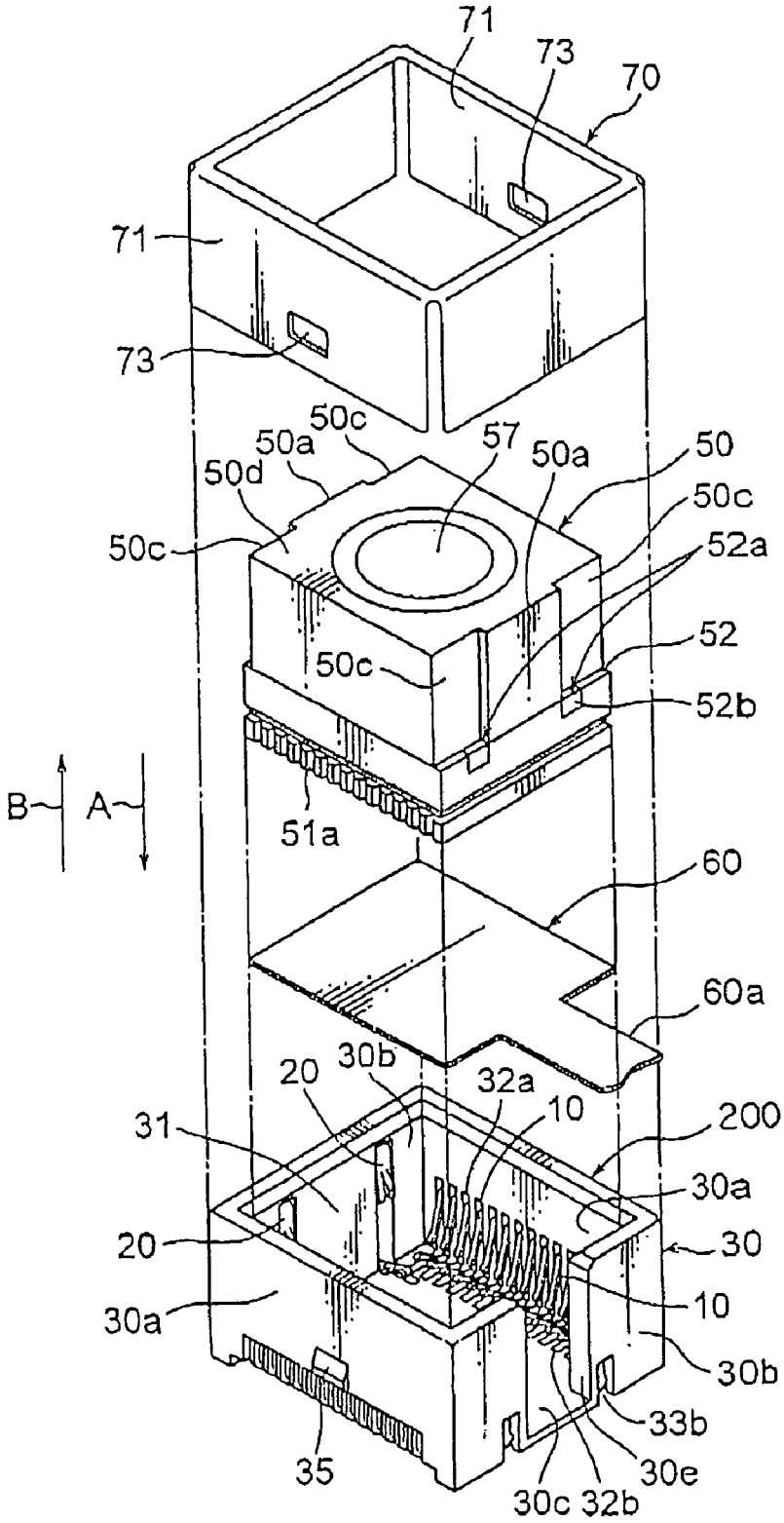
FIG. 6 is an exploded perspective view of a socket connector according to a second embodiment of this invention together with first and second connection objects.
Figure 7A:
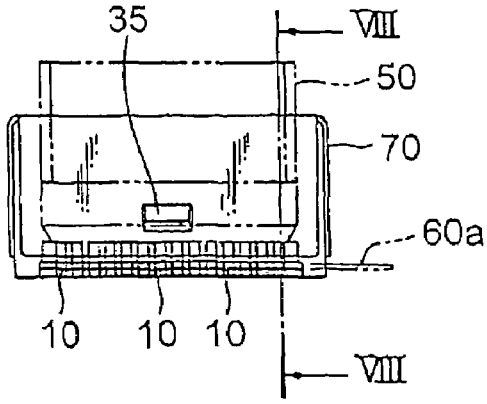
FIG. 7A is a front view of the socket connector illustrated in FIG. 6.
Figure 7B:
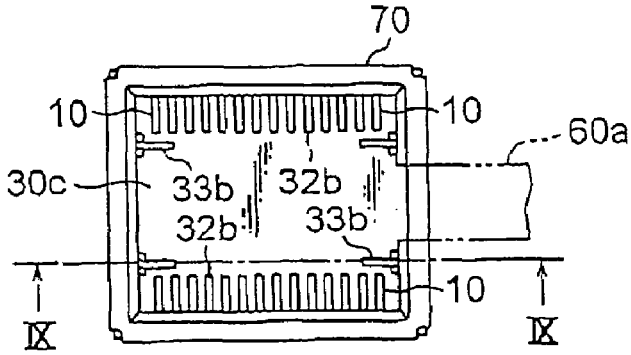
FIG. 7B is a plan view of the socket connector illustrated in FIG. 6.
Figure 7C:
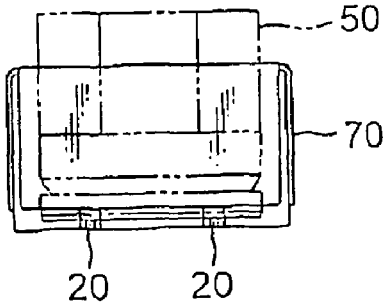
FIG. 7C is a side view of the socket connector illustrated in FIG. 6.

Referring to FIGS. 6, 8, and 9, description will be made of a connecting operation of the above-mentioned socket connector 200.

The first connection object 50 and the second connection object 60 layered thereunder are fitted to the housing 30 in the state where the contact terminal portions 61, the wiring patterns 62, and the terminal portions 63 are faced downward. The first connection object 50 is pushed into the receiving portion 31 in the fitting direction A. Then, the locking portions 24*a* of the engaging members 20 are pushed by the first connection object 50 so that the first engaging spring portions 24 of the engaging members 20 are elastically bent. Further, the first and the second contacting portions 12*a* and 15*a* of the contacts 10 are pushed by the second connection object 60 so that the first and the second spring portions 12 and 15 of the contacts 10 are elastically bent. Simultaneously, the contacting portions 25*a* of the engaging members 20 are pushed by the second connection object 60 so that the second engaging spring portions 25 of the engaging members 20 are elastically bent.

When the engaging portions 52 pass over the locking portions 24*a*, the first engaging spring portions 24 are restored so that the locking portions 24*a* are faced to the second connecting portions 52*a* and the connecting portions 24*b* are brought into press contact with the third connecting portions 52*b*. Further, by a restoring force of the second spring portions 15 of the contacts 10 and a restoring force of the second engaging spring portions 25 of the engaging members 20, the first and the second connection objects 50 and 60 are lifted up. As a result, the locking portions 24*a* of the engaging members 20 are engaged with the engaging portions 52 of the first connection object 50. At this time, the engaging portions 52 of the first connection object 50 are contacted with the engaging members 20. Thus, the first connection object 50 is engaged with the socket connector 200 by the engaging members 20 and electrically connected to the engaging members 20. The second connection object 60 is electrically connected to both of the contacts 10 and the engaging members 20.

After the first and the second connection objects 50 and 60 are fitted to the housing 30, a shell 70 is put on the housing 30 to surround the opening at the upper end of the housing 30 and the first and the second side wall portions 30*a* and 30*b*. The shell 70 has a pair of side plate portions 71 faced to each other and provided with a pair of engaging holes 73, respectively. The engaging holes 73 of the shell 70 are engaged with engaging portions 35 protruding from outer surfaces of the first side wall portions 30*a* of the housing 30 so that the first and the second connection objects 50 and 60 are held.

The engaging portion 52 of the first connection object 50 may be located on the upper surface 50*d* of the first connection object 50. In this case, the second connecting portions 52*a* are formed on the upper surface 50*d* and brought into contact with the locking portions 24*a* of the engaging members 20.

Referring to FIGS. 12 to 17, description will be made of a socket connector according to a third embodiment of this invention. Similar parts are designated by like reference numerals and description thereof will be omitted.

In the socket connector 300, each of second side wall portions 30*b* is provided with one long groove 33*a* formed on its inner surface. On a bottom portion 30*c* continuous from the second side wall portion 30*b* is provided with a long hole 33*b* continuous from the long groove 33*a*. In the long groove 33*a*, an engaging holding portion 21 of each of a pair of engaging members 20 and a part of a first engaging spring portion 24 except its free end and except a free end of a locking portion 24*a* are disposed. In the long hole 33*b*, a connecting portion of the engaging holding portion 21 and a second engaging spring portion 25 is disposed The connecting portion of the engaging holding portion 21 and the second engaging spring portion 25 is connected to a circuit of a printed circuit board (not shown) to which the socket connector 300 is mounted.

On the other hand, the first connection object 50 is provided with a pair of engaging portions 52 in correspondence to the engaging members 20. Each of the engaging portions 52 is formed on each of a pair of first connection side wall portion 50*a* faced to each other. Specifically, each of the first connection side wall portions 50*a* is provided with a recessed portion 50*c* formed on only one side thereof and extending from an upper surface 50*d* towards a bottom surface. Each recessed portion 50*c* is depressed from the first connection side wall portion 50*a* so that a step portion is formed at a boundary between the first connection side wall portion 50*a* and the recessed portion 50*c*. The step portion forms the engaging portion 52.

Each of the engaging portions 52 has a second connecting portion (electrode) 52*a* faced to a removing direction B and a third connecting portion (electrode) 52*b* continuous from the second connecting portion (electrode) 52*a* and faced to a direction perpendicular to the removing direction B Thus, the second connecting portion 52*a* is formed on a plane intersecting the fitting direction of the first connection object 50 while the third connecting portion 52*b* is formed on a plane parallel to the fitting direction A of the first connection object 50.

A first spring portion 12 of each contact 10 may be small in elastic deformability in a vertical direction. Therefore, due to an assembling position of each contact 10 or warping of the second connection object 60, individual contacts 10 may widely be varied in contacting force. Taking this into account, for example, the contact 10 is provided with a lance 16 and is assembled so that the contact 10 is movable by a predetermined distance in the fitting direction A. Thus, variation in contacting force among the individual contacts is absorbed.

The connecting operation of the above-mentioned socket connector 300 is similar to that of the socket connector 200 described in conjunction with FIGS. 6 to 9.

While the present invention has thus far been described in connection with a few embodiments thereof, it will readily be possible for those skilled in the art to put this invention into practice in various other manners. For example, in the socket connector described in each of the foregoing embodiments, one of mating connection objects is a CMOS package while the other mating connection object is a FPC. Not being limited thereto, the mating connection objects may be a semiconductor device module, a semiconductor device package, a printed circuit board, and so on. In this case, the number of the contacts, the number of the engaging members, the number of the first electrodes of one mating connection object and the number of terminal connection patterns of the other mating connection object are appropriately changed in accordance with a design.

What is claimed is:

1. A socket connector for connecting a first connection object to a second connection object, the first connection object having a first connecting portion and an engaging portion formed on opposite sides in an inserting direction, the engaging portion having a second connecting portion having a plane perpendicular to the inserting direction, the socket connector comprising:

a housing having a receiving portion for receiving the first connection object in the inserting direction;

a conductive contact held by the housing; and a conductive engaging member held by the housing;

the contact comprising:

a spring portion for applying, to the first connection object received in the receiving portion, an urging force in a removing direction opposite to the inserting direction;

a contacting portion to be contacted with the first connecting portion; and a terminal portion to be electrically connected to the second connection object, the engaging member having a locking portion to be brought into contact with the engaging portion by the use of the urging force, the locking portion being contacted with the second connecting portion.

2. The socket connector according to claim 1, wherein the contact has a holding portion located between the spring portion and the terminal portion and held by the housing, the contacting portion being disposed in the receiving portion, the terminal portion extending from an end of the holding portion outward from the housing.

3. The socket connector according to claim 1, wherein the first connecting portion is provided on an end face of the first connection object in the inserting direction, the contacting portion being provided on the spring portion to be contacted with the first connecting portion.

4. The socket connector according to claim 1, wherein the first connection object has a third connecting portion faced to a direction intersecting the inserting direction, the engaging member further comprising:

a connecting portion to be electrically connected to the third connecting portion; and a first engaging spring portion for bringing the connecting portion into press contact with the third connecting portion, the locking portion being formed on the first engaging spring portion.

5. The socket connector according to claim 4, wherein the third connecting portion has a plane adjacent to the second connecting portion and extending along the inserting direction, the connecting portion being contacted with the third connecting portion when the locking portion is engaged with the engaging portion.

6. The socket connector according to claim 4, wherein the engaging member further comprises:

a terminal portion to be connected to the second connection object; and a holding portion connecting the first engaging spring portion and the terminal portion of the engaging member and held by the housing.

7. The socket connector according to claim 6, wherein the terminal portion of the engaging member extends outward from the housing.

8. The socket connector according to claim 1, wherein the first connecting portion is provided on an end face of the first connection object, which faces a direction intersecting the inserting direction, the contacting portion being brought into press contact with the first connecting portion.

9. The socket connector according to claim 8, wherein the second connection object is disposed in the receiving portion to be interposed between the first connection object and the spring portion, the terminal portion being provided on the spring portion to be electrically connected to the second connection object.

10. The socket connector according to claim 9, wherein the housing has a cut portion to extract a part of the second connection object from the receiving portion.

11. The socket connector according to claim 9, wherein the contact is held by the housing to be movable by a predetermined distance in the inserting direction and in the removing direction opposite to the inserting direction.

12. The socket connector according to claim 9, wherein the engaging member further comprises:

a terminal portion to be connected to the second connection object; and a holding portion connecting the first engaging spring portion and the terminal portion of the engaging member and held by the housing.

13. The socket connector according to claim 12, wherein the terminal portion of the engaging member extends into the receiving portion to be electrically connected to the second connection object.

14. The socket connector according to claim 13, wherein the terminal portion of the engaging member applies, to the first connection object received in the receiving portion, an urging force in the removing direction opposite to the inserting direction.

* * * * *